United States Patent [19]

Smith

[11] Patent Number: 4,534,073

[45] Date of Patent: Aug. 13, 1985

[54] TOILET SEAT LIFTER

[76] Inventor: Gene Smith, 411 East 4th St., La Fallotte, Tenn. 37766

[21] Appl. No.: 516,206

[22] Filed: Jul. 21, 1983

[51] Int. Cl.[3] ..... A47K 13/10

[52] U.S. Cl. ..... 4/251; 4/661

[58] Field of Search ..... 4/251, 253, 250, 661

[56] References Cited

U.S. PATENT DOCUMENTS

| | | | |
|---|---|---|---|
| 2,232,895 | 2/1941 | White | 4/251 |
| 2,251,770 | 8/1941 | Warner | 4/251 |
| 2,473,082 | 6/1949 | Warner | 4/251 |
| 2,705,330 | 4/1955 | Knudsen | 4/251 |
| 2,776,440 | 1/1957 | Miller | 4/251 |
| 3,303,517 | 2/1967 | Wood et al. | 4/251 |
| 3,417,411 | 12/1968 | Greenwood | 4/251 |
| 4,426,743 | 1/1984 | Seabrooke | 4/251 |

*Primary Examiner*—Henry K. Artis

*Attorney, Agent, or Firm*—Pitts and Brittian

[57] ABSTRACT

A toilet seat lifting apparatus (10) mounted on a commode bowl (52) of conventional design and shown to connect with a water reservoir (53). However, the lifting apparatus is designed to be mounted on various types of toilets such as those having a pressurized water conduits connected directly with the bowl. The apparatus is designed to be mounted contiguous (11) with the surface supporting the toilet seat (46) thereby conveniently positioning a foot pedal (16) at some selected height above the floor and eliminating the need to stablize the lifting apparatus by contact with the floor.

The lifting apparatus features a system of levers (10) mechanically operated by the foot action of the user. The lifting motion produced by the leverage system is compensated by a tension spring (44) incorporated into the structure of the lifting apparatus (10). The tension spring additionally functions to dampen the return of the toilet seat (46) to the resting position (54). The toilet seat lifting apparatus (10) offers a simple design wherein components can be easily assembled and the apparatus readily installed even by a user lacking mechanical skills.

6 Claims, 2 Drawing Figures

TOILET SEAT LIFTER

DESCRIPTION

1. Technical Field

This invention relates to a toilet seat supported by a commode bowl of conventional design and particularly to a toilet seat lifting apparatus mounted on the commode bowl and positioned at a selected height from the floor.

2. Background Art

Mechanisms designed to lift a commode seat have heretofore been known. All such known mechanisms must be bolted to the floor adjacent to the commode for the purpose of stablizing a foot pedal designed to initiate the lifting force. Prior lifting devices vary in operating principles from a pulley apparatus to those incorporating complex piston mechanisms expensive to repair or replace.

Impracticality and undue complexity disadvantage such prior designs resulting in a shortened operational life leaving the expense to be borne by the unwary purchaser. Moreover, the rigid attachment to the floor space adjacent to the commode of a mechanism featuring complicated working parts is subject to constant corrosive cleaning agents used to maintain sanitation in toilet areas.

Prior designs are described in U.S. Pat. Nos. 2,661,484; 2,954,565; 3,504,385; 3,345,650 and 4,150,446. The spring operated toilet seat mechanism (U.S. Pat. No. 2,954,565) by M. Miller displays a system involving spring action. Such patented designs contain prominent features comparable to each other. The unique simplicity of the present invention features a positioned lever system of adjustable height from the floor reducing manufacturing expense and promoting sanitation practices. The devices of prior art suggest areas of improvement by simplifying complex design features but yet retaining the operational benefits offered by a toilet seat lifting apparatus.

DISCLOSURE OF THE INVENTION

An object of the present invention is to make available a toilet seat lifting apparatus featuring a simple lever system operating to lift the toilet seat and simultaneously control spring action lowering the toilet seat to the resting position.

A further object is to secure the lifting apparatus to the top surface of the commode bowl by a mounting arm containing a plurality of circular openings to allow a universal fit. This arrangement allows immediate installation upon previously manufactured commode bowls and eliminates the need for skilled assistance in installing.

An object is to provide spring action serving the dual purpose of facilitating the lifting leverage and dampening the subsequent return of the toilet seat to the resting position.

Another object is to provide the consumer a toilet seat lifting arrangement easy to assemble having inexpensive replaceable parts, pleasing appearance, and durable construction.

An object is to offer a design whereby the leverage system is secured at an adjustable height above the floor thereby eliminating the need to bolt the leverage device to the floor adjacent to the toilet.

An important object is to provide the manufacturer a design permitting variety in constructing materials thereby conserving cost.

In summary, the embodiment of the present invention features an operator controlled toilet seat lifter secured to the toilet and positioned at a preselected adjustable height from the floor. A foot pedal is operated by a user to actuate a lever system and produce lift allowing a lifting arm to contact and raise the toilet seat. A tension spring assists mechanically in the lifting and lowering of the toilet seat.

BRIEF DESCRIPTION OF THE DRAWINGS

A study of the drawings and specifications will make more apparent these aforementioned design objects and reveal other advantages offered by the simple and unique design of the present invention wherein.

BEST MODE FOR CARRYING OUT THE INVENTION

A conventional toilet constructed in conformity with the features of the present invention is provided which has a toilet seat lifting apparatus selectively positioned on the commode top surface. The toilet seat lifting apparatus includes a mounting bracket described as a single bar bracket. One end portion of the mounting bracket is secured to the commode bowl, and the opposite end portion secures the positioned lever system at an adjustable height from the floor. In the present embodiment the lever system is secured to the mounting bracket at two positions one said position being the further end of a first lever bar and the second position some point intermediate on a second lever bar.

A spring assembly carried by the lever system serves to compensate the lift motion effected on the toilet seat and dampen the return of the toilet seat.

The lever system is acturated by the foot action of a user operating a foot pedal supported by the first lever bar. Such leverage is finally realized by a lifting rod supported by the last bar lever within the lever system.

Figure 1:
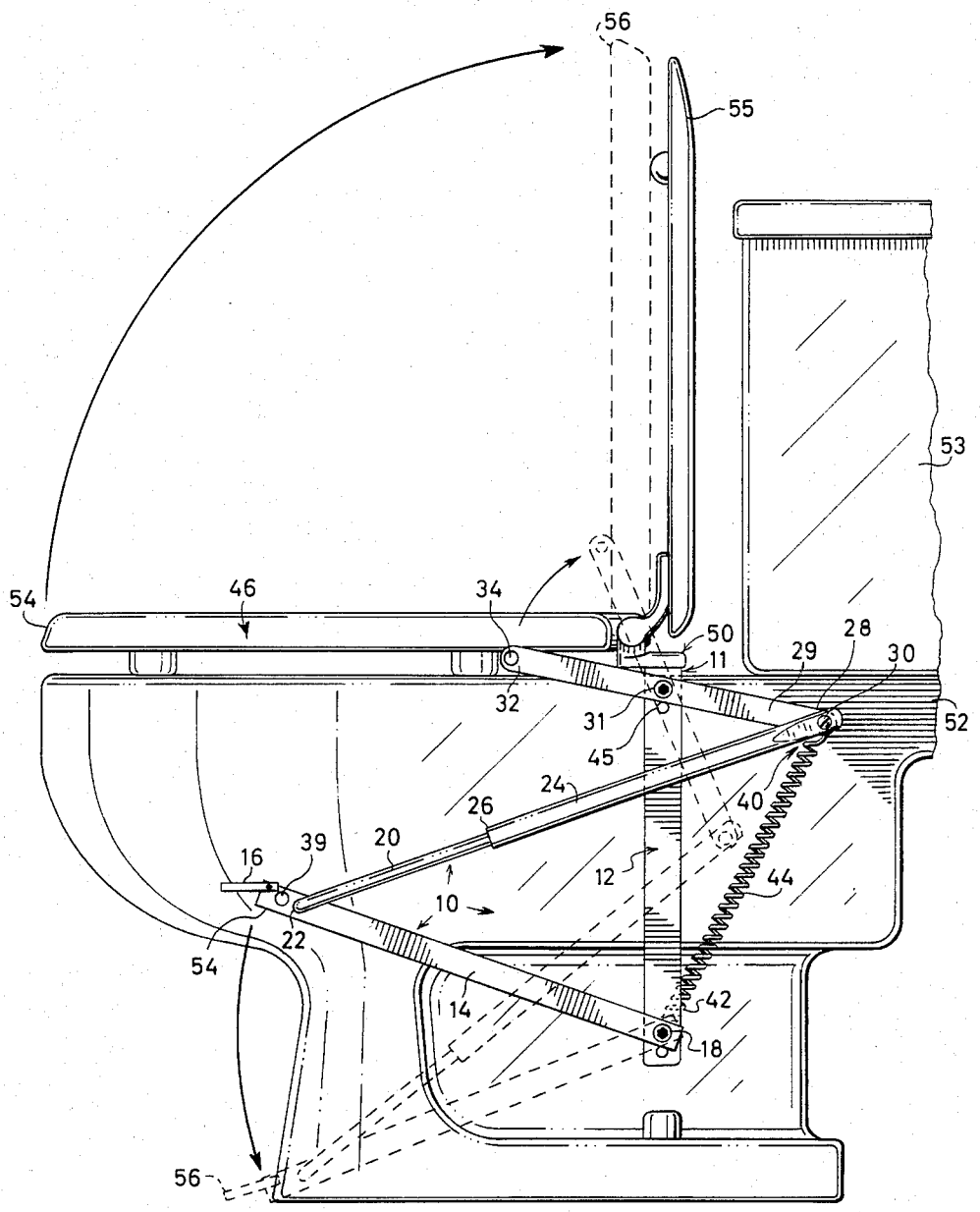
FIG. 1 illustrates by a side elevational view the toilet seat lifting apparatus showing said apparatus in alternate positions.

FIG. 1 shows an arrangement of the toilet seat lifting apparatus 10 mounted on a toilet bowl of conventional type. Further illustrated in FIG. 1 is a side view of a conventional toilet composed of a water reservoir 53, commode bowl 52, the toilet seat 46 resting on the commode bowl, and the toilet seat lid 56. The configuration of FIG. 2 enlarges the toilet seat lifting apparatus showing one embodiment in prospective view.

The leverage system 10 is secured to the surface of a commode bowl 52 and the connectors 50 of the toilet seat 46 by means of a single bar bracket wherein end portion 11 of mounting bracket comprised of ends 11 and 12 is secured. One efficient means to secure the toilet seat lifting apparatus 10 is the passage of bolts through a circular opening 38 in the mounting bracket portion 11 determined from a plurality of preselected spaced circular openings 38 as depicted in FIG. 2 and concentric to the circular openings whereon the toilet seat connects with the commode bowl.

The said mounting bracket portion 11 is firmly attached to the commode and effectively positions the lever system 10 in a manner whereby no further contact is made with the commode or floor.

Figure 2:
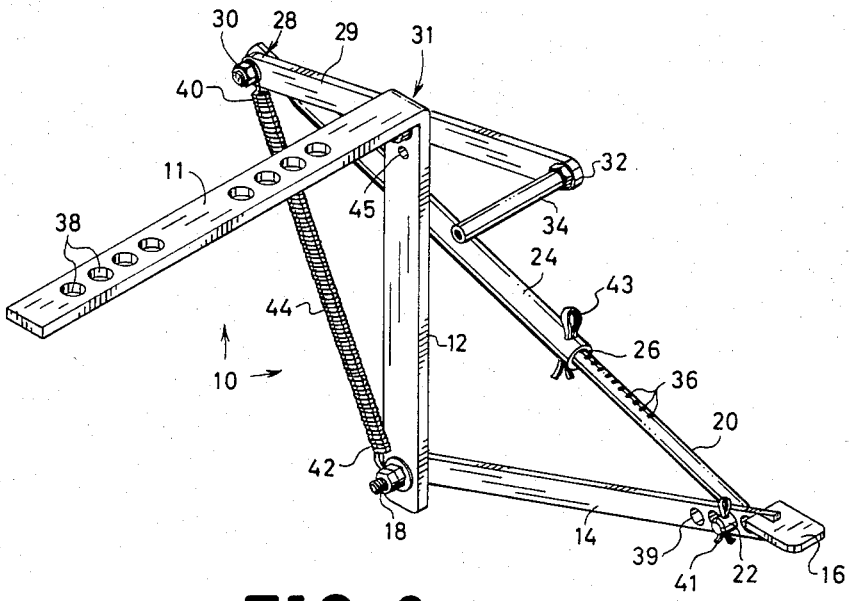
FIG. 2 depicts an enlarged perspective view of the toilet seat lifting apparatus.

Referring to FIG. 2, there is shown a perspective view of the lifting apparatus. The forward end of first lever bar 14 is equipped with an upward rotatable foot pedal 16 and the further end of first lever bar 14 is firmly joined to the extended mounting bracket second portion 12 which in the present embodiment 10 extends vertically to firmly receive the further end of first lever bar 14 by means of a pivotal bolt 18. Operating unitarily the foot pedal 16 and first lever bar 14 act as a single lever.

The first end 22 of an adjustable cylindrical connecting rod 20, 24 is presently embodied as appropriately angled to pass the end 22 through a preselected circular opening 39 spaced with plural openings in the first lever bar end wherein said first cylindrical rod end 22 is received and secured by a pin 41 at end 22 or other suitable means allowing rotation within the joint. The pivotal joining of first connecting rod end 22 to first lever bar 14 may be effected by alternate means.

The first member 20 of the cylindrical connecting rod 26 fits telescopically into the second member 24 of said connecting rod and is secured by a pin 43 or other suitable means by telescoping second member 24 forward or backward on first member 20 until a circular opening on the first end of the second cylindrical rod member 26 coincides with a preselected circular opening 36 among plural said openings spaced on the second end of the first cylindrical rod member 20 to allow adjustment in the total length of the adjustable cylindrical connecting rod. This described configuration enables adjustments to be made within the leverage system 10 to produce a controlled amount of lift on the toilet seat 46.

The first end 28 of the second lever bar 29 connects to the further end of the cylindrical connecting rod 24. Said first end 28 of the second lever bar is biased with such bias diminishing gradually along the longitudinal axis directed toward the further end 32 of the second lever bar. At some position between the first and further ends the said second lever bar 28 is pivotally secured as at 31 to the vertically aligned mounting bracket 12 allowing the further end 32 to rotate around such secured position to effect the lifting movement.

Angularly joined to the further end 32 of second lever bar 29 is a lifting rod 34 upon which rests the toilet seat 46.

FIG. 2 depicts a spring assembly 44 incorporated into one embodiment of the lever system 10. The first end 42 of an elongated spring 44 is joined to the pivotal facet 18 securing the further end of first lever bar 14 to the vertically inclined mounting bracket portion 12. The said spring extends until further spring end 40 meets the freely moving pivotal joint 30 described as joining the further end of the cylindrical connecting rod 24 and the first end 28 of the second bar lever 29. The inward bias of said pivot 30 allows the spring 40 to extend without askew thereby eliminating dissipating forces. As the cylindrical connecting rod moves the pivotal joint 30 described as joining the further end of cylindrical connecting rod 24 to the first end 28 of second lever bar 29 to move correspondingly thereby releasing tension on spring 44. The lowering of the toilet seat 46 to the resting position 54 places said spring 44 in tension and thereby dampens the fall of said toilet seat 46.

The lifting assemblage is actuated from the resting position 54 to the alternate position 56 by the following operation:

Foot pedal 16 is depressed moving the adjustable cylindrical connecting rod formed by the component first rod member 20 and component second rod member 24. The resulting motion of unsecured pivotal joint 30 then rotates lifting arm 29 around positional axis 31. This action moves lifting rod 34 through a proportionate angle thereby lifting the toilet seat 46 to the alternate position 56.

Throughout the lifting apparatus plural circular openings spaced adjacently demonstrated at 36, 45 allow adjustable positions of attachment permitting variable height and leverage action to be preselected within the system of lifting levers 10.

It will be obvious to those skilled in the art that features described are at present considered to be preferred embodiments wherein various changes and modifications may be made without departing from the invention and whereby such description is intended to cover all such changes and modifications as fall within the true spirit and scope of this invention.

I claim:

1. A toilet seat lifting apparatus for use on toilets at a preselected height above the floor and secured on the toilet bowl juxtapositioned to the toilet seat forward of the water reservoir and comprising:

a mounting bracket carried by said toilet bowl whereupon said toilet seat lifting apparatus is attached at some preselected height above the floor, said, mounting bracket further characterized as a single bar bracket, said bar bracket having first and second opposite end portions, said first end portion projecting horizontally and attached firmly to said commode bowl, said second end portion directed vertically and carrying a leverage system mounted on said mounting bracket, said leverage system including a foot pedal operable by a user at said preselected height above the floor to perform a lifting and lowering motion on said toilet seat, said leverage system further including a first lever bar carrying said foot pedal and having a first end and a second end, said first end carrying said foot pedal, said second end pivotally connected to said second end portion of said single bar bracket, at least some of said end portions containing preselected circular openings, an adjustable connecting rod having a first rod member, said first rod member having a first end and a second end, each of said first rod member ends having a preselected plurality of circular openings, said first end of said first rod member joining pivotally with said first end of said bar lever juxtapositioned forward of said foot pedal, said adjustable connecting rod having a second rod member of greater preselected diameter than said first rod member, said second rod member having a first end and a second end, each of said second rod member ends having a preselected plurality of circular openings, a second lever bar having a first end portion connected pivotally with said second end of said second rod member of said adjustable connecting rod, said second lever bar having an intermediate pivotal connection to said single bar bracket, said second lever bar having a second end portion carrying a rigidly joined substantially perpendicular lifting rod, said lifting rod having a first end and a second end, said first end rigidly joined substantially perpendicular to said second end of said second lever bar and contacting the undersurface of said toilet seat along a portion of the length of said lifting rod, a tension spring having a first end and a second end, said first end attached to the pivotal connection of said second end of said first lever bar with said second end portion of said single bar bracket, said second end of said spring attached to the pivotal connection of said first end of said second lever bar with said second end of said second rod member of said connecting rod.

2. The apparatus of claim 1 having said second end of said first rod member to adjustable fitting telescopically into said first end of said second rod member, said openings on the second end of said first rod member and said openings on the first end of said second rod member receiving suitable means to secure said first and second rod members together such that said connecting rod may be adjustable in length to enable said leverage system to be selectively adjusted internally for convenience to the user.

3. A toilet seat lifting apparatus for use, at a preselected height above the floor, on toilets and secured on the toilet bowl juxtaposed to the toilet seat forward of the water reservoir and comprising:

a mounting bracket attached at the rear of the toilet bowl for connecting said lifting apparatus to said toilet bowl, said mounting bracket having a horizontal portion provided with apertures to receive mounting bolts of said toilet seat, and a vertical portion adjoined to one end of said horizontal portion, and having a digital end and a plurality of apertures spaced along its length;

a leverage system mounted on said vertical portion of said mounting bracket in selected of said apertures of said vertical portion said leverage system comprising:

a first lever arm having a first end pivotally connected to said vertical portion at a first selected one of said apertures proximate said digital end, and a second end, a second lever arm having a first end, a second end, and a mid portion, said mid portion pivotally mounted to said vertical portion of said mounting bracket at a further selected one of said apertures proximate juncture with said horizontal portion, an adjustable length connection rod joining said second end of said first lever arm to said first end of said second lever arm, a tension member connected between said first end of said first lever arm and said first end of said second lever arm, a foot pedal connected to said second end of said first lever arm, and a lifting arm having a first end connected perpendicularly to said second end of said second lever arm, and a second end for contact with a lower surface of said seat;

wherein said adjustable length connecting rod and said multiplicity of apertures in said vertical portion of said mounting bracket provides for such preselected height above said floor; and whereby movement of said foot pedal toward said floor elevates said second and of said lifting arm and said toilet seat.

4. The toilet seat lifter of claim 3 wherein said adjustable length connecting rod comprises coextensive first and further portions each provided with apertures, and a pin passing through a selected aperture of each of said portions permitting a selection of the length of said connecting rod for adjustment of the spacing of said leverage system above said floor.

5. The toilet seat lifter of claim 4 wherein said first portion of said connecting rod telescopes axially within said further portion of said connecting rod.

6. The toilet seat lifter of claim 3 wherein tension of said tension member is reduced by movement of said foot pedal toward said floor, and increased as said foot pedal moves away from said floor whereby lowering of said toilet seat is opposed thereby decelerating the lowering of said seat.

* * * * *